United States Patent [19]

Obermann et al.

[11] 4,413,164

[45] Nov. 1, 1983

[54] TIMER WITH MANUAL MEANS FOR DISABLING A SWITCH

[75] Inventors: George Obermann, Niles; Edward J. Mateja, Hillside, both of Ill.

[73] Assignee: The Singer Company, Stamford, Conn.

[21] Appl. No.: 370,721

[22] Filed: Apr. 22, 1982

[51] Int. Cl.[3] ..... H01H 43/10

[52] U.S. Cl. ..... 200/38 R; 200/38 B; 200/38 C; 200/61.19; 200/153 M

[58] Field of Search ..... 200/38 R, 38 A, 38 F, 200/38 FA, 38 FB, 38 B, 38 BA, 38 C, 38 CA, 38 D, 38 DA, 38 DB, 38 DC, 38 E, 153 M, 39 R, 39 A, 61.19

[56] References Cited

U.S. PATENT DOCUMENTS 3,752,944 8/1973 Cartier et al. ..... 200/38 C 4,355,217 10/1982 Cushing ..... 200/38 B

*Primary Examiner*—Elliot A. Goldberg

*Assistant Examiner*—Morris Ginsburg

*Attorney, Agent, or Firm*—David L. Davis; Robert E. Smith; Edward L. Bell

[57] ABSTRACT

The rotating program drum of the timer operates the timer switches in a predetermined sequence. One or more timer switches can be disabled to omit the function of the switch. Means are rotatably mounted in the frame to move a passive switch blade away from the active blade so the active blade cannot contact the passive blade. In two embodiments the disabling means operates on a switch at the end of the program drum while a third embodiment can operate on any of the switches operated by the drum.

11 Claims, 13 Drawing Figures

Fig. 2
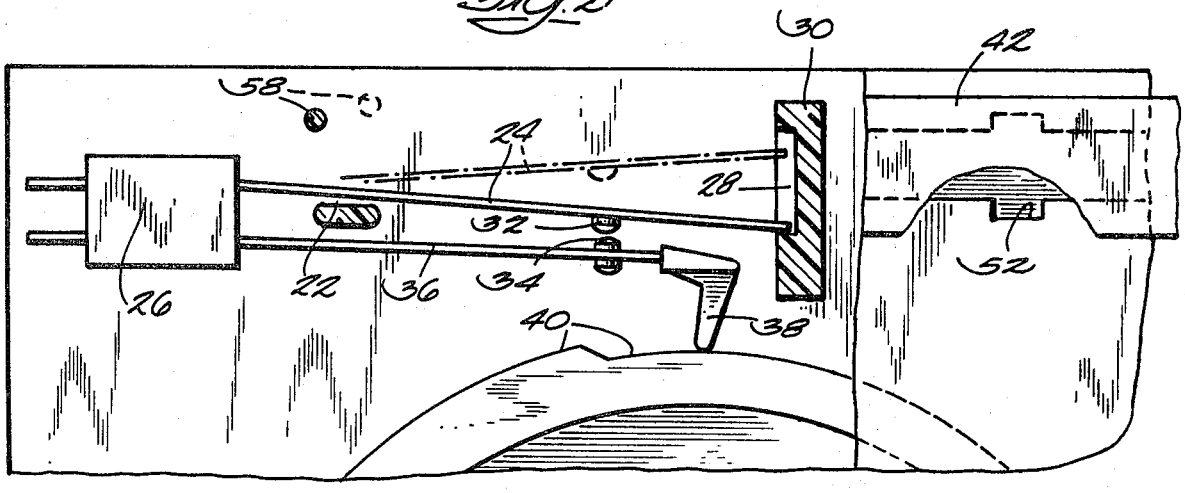
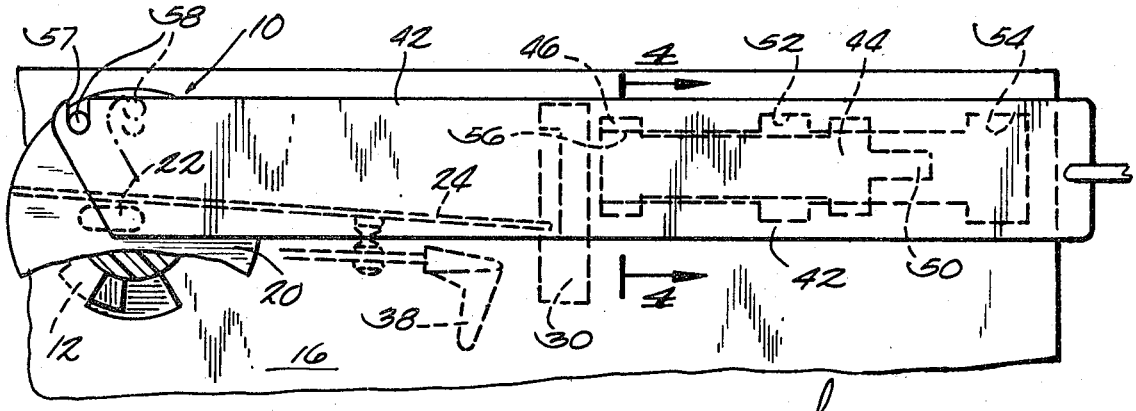
Fig. 1
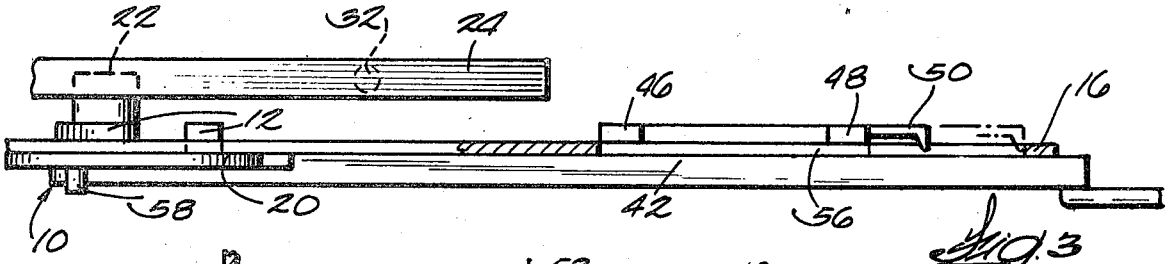
Fig. 3
Fig. 4
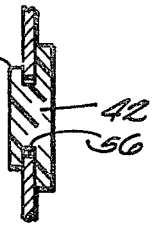
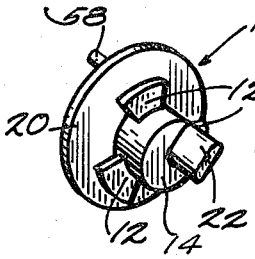
Fig. 5

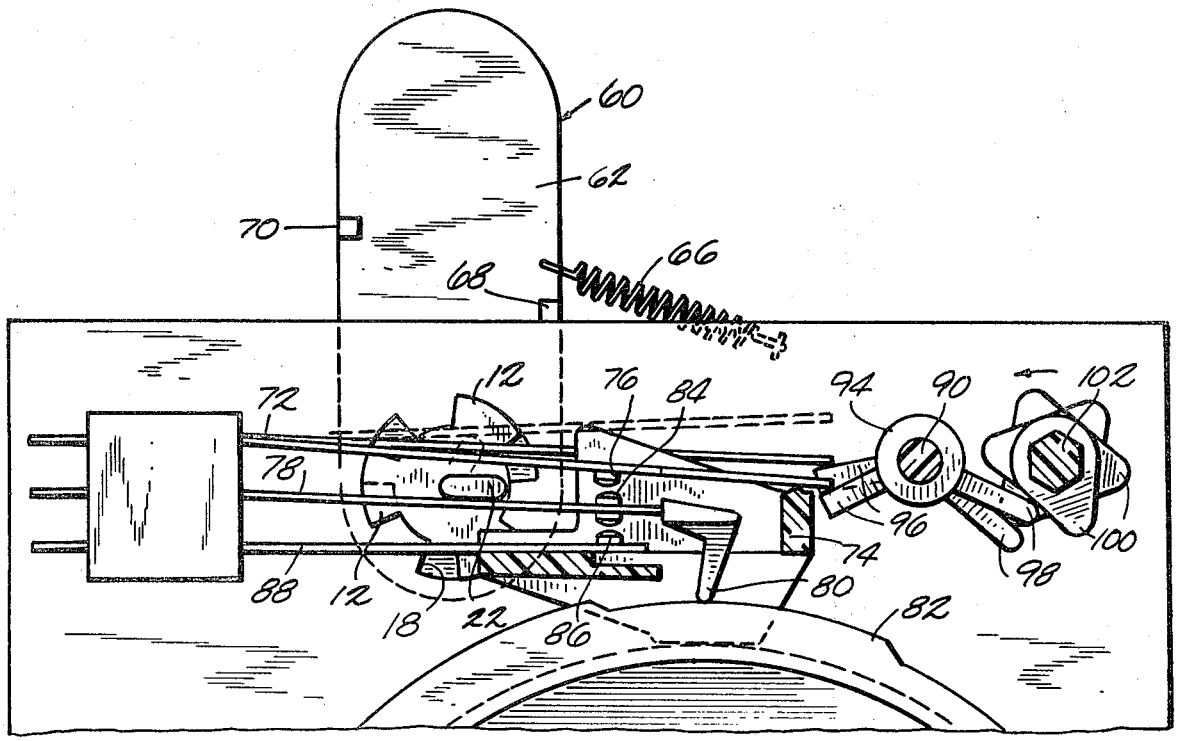
Fig. 9
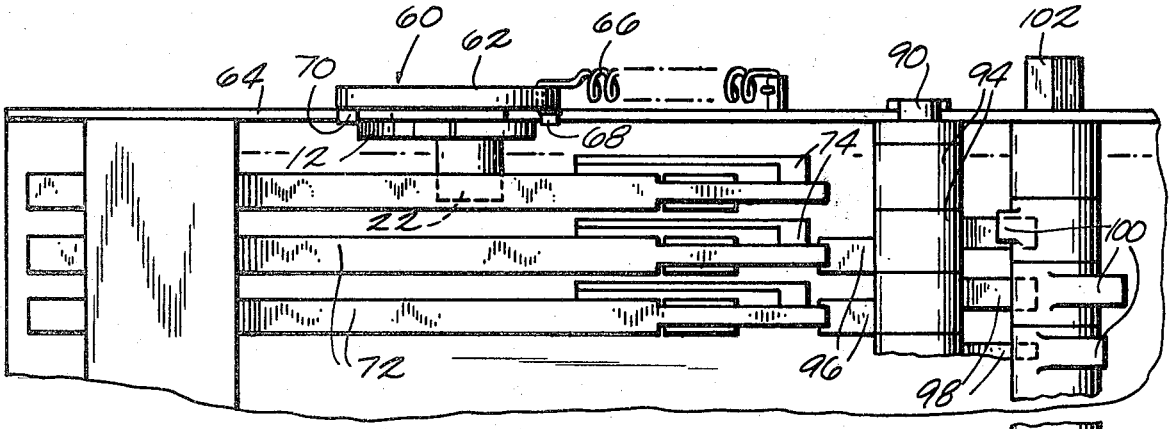
Fig. 10
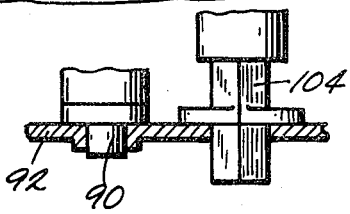

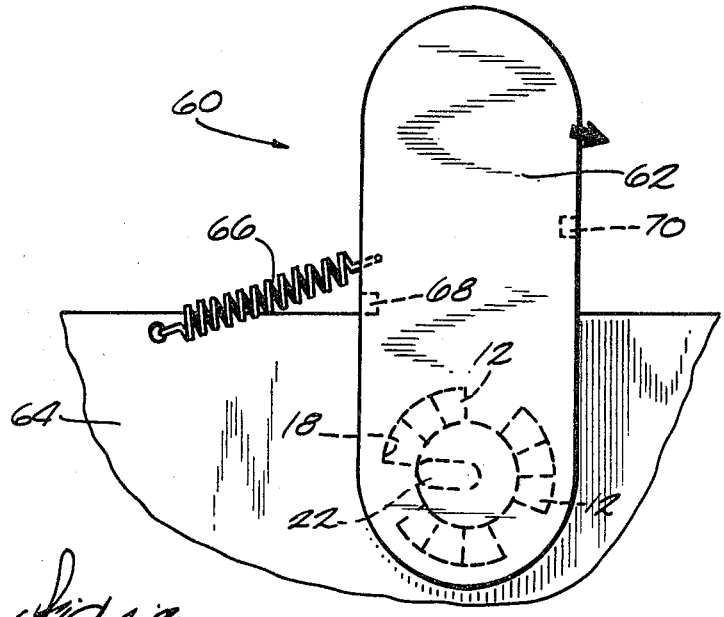
Fig. 12.
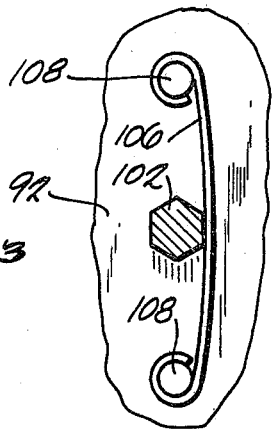
Fig. 13
Fig. 11
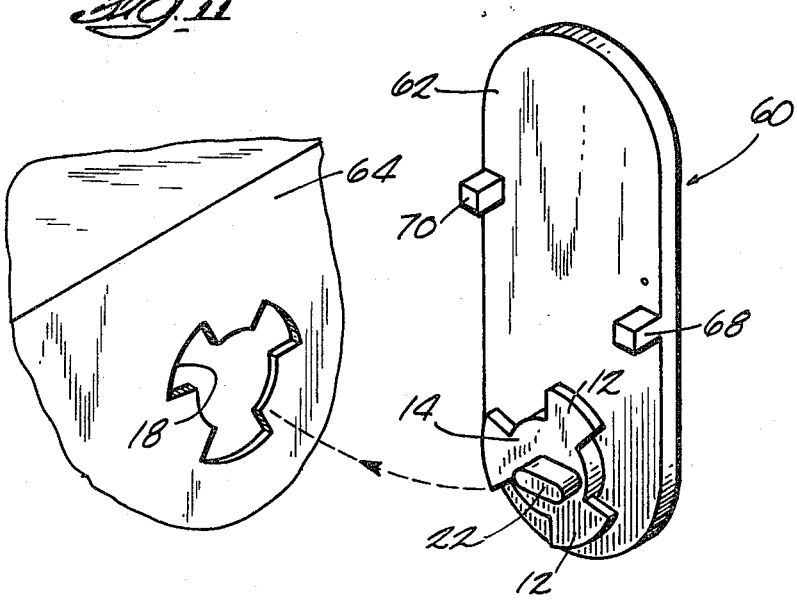

TIMER WITH MANUAL MEANS FOR DISABLING A SWITCH

BACKGROUND OF THE INVENTION

Program timers for clothes washers, dishwashers and the like are provided with switching capability to handle all possible program demands. But, for various reasons, it may be desired to omit one or more of the functions controlled by the timer. For example, while the program timer may control an electric heater for air drying dishes, the user may not want to use heated air. Heretofore, omission of a programed function has been accomplished by providing a user operated switch in series with the timer switch so that when the function is to be omitted, the separate switch is actuated to open the circuit and prevent the timer from energizing the component. A separate switch is costly and requires wiring to the circuit as well as separate mounting on the control panel.

SUMMARY OF THE INVENTION

The object of this invention is to provide a program timer with a simple low-cost mechanism for inhibiting operation of a selected timer switch. More specifically, the object is to provide means rotatably mounted in the timer frame and engageable with a timer operated switch to move the switch blade to an inoperative position. In two of the three embodiments shown, the switch disabling member is rotatably mounted in an end plate of the timer by means of a simple key arrangement which, when the member is rotated to a position within its operating range, locks the member to the plate while permitting the member to be rotated. The rotation can be accomplished either by a lever extension operable to move the member between operative and inoperative positions or, in the other version, a slider is mounted on the plate for limited linear movement and engaged with the rotating switch actuating member. In both of these two embodiments the switch actuating member is operative to disable the adjacent switch in the timer.

The third embodiment provides a plurality of switch plade actuators on a shaft journaled between the end plates of the timer for rocking movement. An actuator is provided adjacent the end of each switch to be modified, and each actuator has an arm underlying the end of a switch blade so that when the arm is raised, the blade and the contact carried by it are elevated to a position in which the blade below is unable to reach and close on the elevated blade. Each actuator has a follower arm underlying a cam-like inhibitor mounted on a shaft journaled between the end plates of the timer. The shaft has six rotational positions, and thus, the various inhibitors can be arranged to selectively disable adjacent switches through the associated actuator when the inhibitor has been rotated to its active position. With this arrangement the user is able to select, for example, six modifications of the basic timer program by rotating the inhibitor shaft to the desired location.

BRIEF DESCRIPTION OF THE DRAWINGS

FIG. 1 is a fragmentary elevation of a portion of a timer provided with a slider actuating the rotating member which, in turn, disables a timer switch.

FIG. 2 is similar to FIG. 1, but has parts broken away to show the relationship of the timer switch to the program cam and to the disabling mechanism.

FIG. 3 is a horizontal section through FIG. 1.

FIG. 4 is a section through the slider and a timer end plate showing the manner in which the slider is retained in the end plate.

FIG. 5 is a perspective view of the rotary member showing the keys projecting from the hub.

FIG. 9 shows vertical sections from inside a timer provided with two types of switch disabling means, one being a lever actuated rotary member, and the other being an arrangement for multiple switch disabling through the medium of actuators mounted on a jackshaft and actuated by cams carried on a parallel shaft.

FIG. 10 is a top plan view of the arrangement shown in FIG. 9.

FIG. 11 shows the manner in which the lever actuated rotary member is keyed into the end plate.

FIG. 12 is a vertical section from outside the timer showing further details of the manner in which the lever actuated rotary member is mounted to the timer end plate.

FIG. 13 is a detailed view of the manner in which the cam carrying shaft is detented.

DETAILED DESCRIPTION OF THE DRAWINGS

Figure 8:
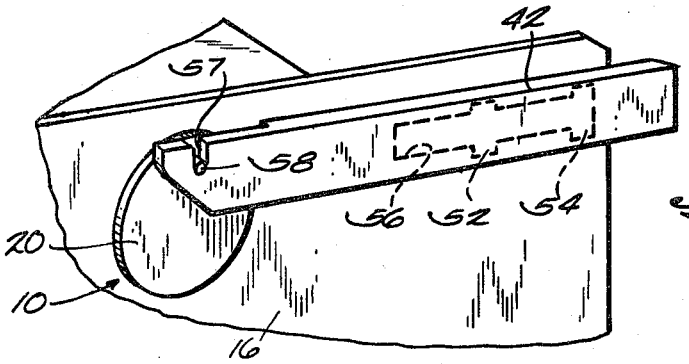
FIG. 8 shows the assembly of the slider to the timer completed.

The switch actuating rotary member 10 has three keys 12 projecting radially from the hub 14 while the timer end plate 16 is provided with a stamped opening having a circular center portion receiving hub 14 and three key slots 18 receiving the keys during the mounting process. When the keys have been passed through the plate 16, the member 10 is rotated to its general operating position with the circular head 20 against the outside of the timer plate 16 so keys 12 engage the inside of the plate 16 to retain the member in position. The switch actuator 22 projecting from the hub lies under switch blade 24 mounted in block 26. Blade 24 is self-biased downwardly so its free end bears against the bottom of guide slot 28 in member 30 to position contact 32 above contact 34 carried by moveable blade 36 also mounted in block 26. The free end of blade 36 is provided with a follower 38 riding on timer program cam track 40. Normally, when the program cam 40 rotates to raise the follower, the contact 34 will engage contact 32 and complete a circuit. But if the actuator 22 carried by the rotary member 10 is rotated from its enabling position (FIGS. 1 and 2) to its disabling position it will lift blade 24 and raise contact 32 to an elevated position out of reach of the moving contact 34, thus disabling the switch and preventing closure of the circuit even though the cam track calls for closure of the circuit.

Figure 7:
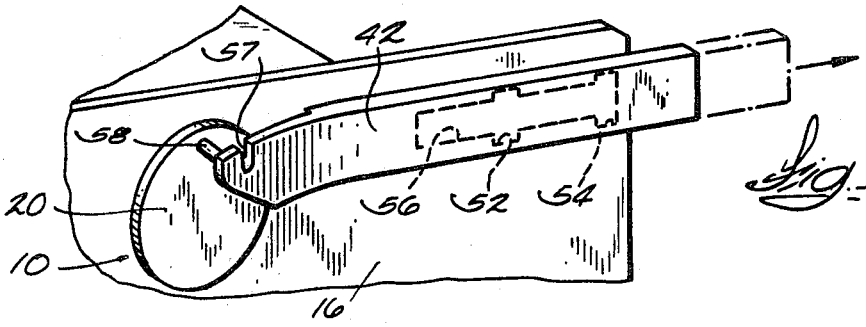
FIG. 7 shows the slider parallel to the plate and keyed into the plate with the end flexed to engage the crank pin on the rotary member already mounted in the end plate.
Figure 6:
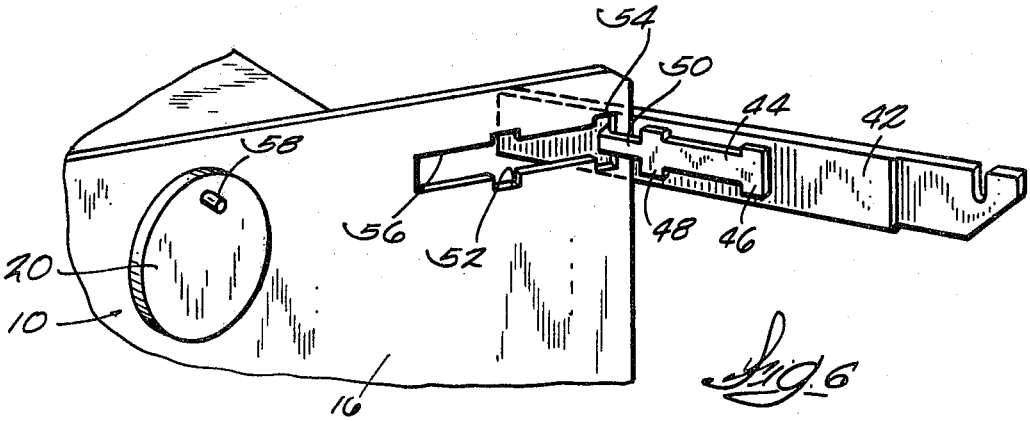
FIG. 6 shows the manner in which the slider is hooked to the frame in preparation for swinging the slider into parallel relationship with the end plate for keying the slider to the end plate.

Only a limited amount of rotation of the member 10 is required to move actuator 22 to its disabling position. In this embodiment, member 10 is actuated by means of slider 42 mounted on plate 16 for linear movement. Slider 42 is a molded plastic part on the inside of which there is molded generally rectangular glide block 44 having keys 46 at one end of the block and another pair of keys 48 near the other end of the block. At the latter end there is an integral molded hook-like extension 50 which, when the slider is to be mounted on the plate 16, is hooked over the end of the plate 16 as shown in FIG. 6. The slider is now pivoted around the point and moved toward the right relative to plate 16 so as to align the keys 46, 48 with key slots 52, 54 emanating from the elongated slot 56 in plate 16. This enables the keys 46, 48 to "get behind" plate 16 whereupon the lever is moved to the left to engage the keys back of the plate while the central block portion 44 is guided by slot 56 for linear travel. As can be seen in FIG. 3, the hook portion 50 is now disengaged from the end plate and projects into slot 56. As can be seen in dotted lines in FIG. 3, the hook 50 will engage plate 16 at the far right travel of the slider which will prevent realigning the keys 46, 48 with their respective slots which would, of course, allow the slider to fall out of the plate. The left end of the slider (FIG. 7) is flexible and is flexed to engage the slot 57 with the crank pin 58 projecting from the head 20 of rotary member 10. Now as the slider moves between its limits of travel (as determined by the hook engaging end of slot 56 on the far right travel and by the central block 44 engaging the left hand end of slot 56 on the other end of the travel) the switch blade 24 is moved between active and inactive positions.

It will be appreciated the rotary member is mounted simply by means of a key or bayonet-type connection permitting rotational movement but retaining the rotary member on the plate. Similarly, the slider is captured on the plate. The only parts required to provide for disabling the switch are the rotary member and the slider, both of which are inexpensive plastic parts. The manner of mounting and retaining the parts on the timer does not require additional parts. This construction can operate to disable only the switch immediately adjacent the timer end plate.

FIGS. 9, 10, 11, and 12 show a similar type rotary member for disabling a switch, but in this case the head of rotary member 60 includes an integral lever-type actuating arm 62 and eliminates the slider, the member 60 retaining the feature of the central hub 14 and the keys 12 which pass through the cutout 18 in the end plate 64 of the timer. This rotary member 60 operates in the same manner as the one actuated by the slider except that in this case the lever 62 is actuated in the direction of the arrow (FIG. 12) to disable the end switch in the time. The lever 62 is biased to its (timer switch operative) position by tension spring 66 connected to the lever and to the plate 64. The back side of the lever can be provided with a boss 68 engageable with the timer end plate 64 to limit the movement of the lever under influence of spring 66. Another stop boss 70 can be provided to engage the plate 64 and limit the movement of the lever against the action of the spring in the direction to disable the switch. It will be appreciated that some provision would normally be made for retaining the lever in the switch disabling position. This can be by latch or over-center devices or the like.

The lever actuated member is also operative to work on only the switch immediately adjacent the end plate on which the lever is mounted. FIGS. 9 and 10 show a construction in which interior switches can be disabled. Thus, in this arrangement the top blade 72 of each of the various switch assemblies projects beyond and is biased against the limit stop 74 fixed in the timer frame to locate the upper switch contact 76 with reasonable precision. The middle blade 78 is provided with a follower 80 riding on cam track 82 which, in FIG. 9, is shown as having three radial levels thus permitting the switch assembly to be double acting; that is, the contact 84 on the middle blade can engage the upper contact 76 or the lower contact 86 carried by the lower blade 88. The switch adjacent the timer end plate 64 appears in the background of FIG. 9 but the interior switch shown in full lines is one we are concerned with at this point. To disable the interior switches, a jackshaft 90 is fixed between the timer end plates 64, 92 to support various actuators 94. Each actuator is independently rockable on the shaft 90 and each actuator includes an arm 96 underlying the tip of the upper blade 72 and each actuator includes a follower 98 engageable with an associated cam 100 fixed on and rotatable with the square shaft 102 journaled between the timer end plates 64, 92. When the lobe of cam 100 engages follower 98 to move the follower away from the center of shaft 102, the actuator 94 rocks in a clockwise direction causing arm 96 to lift the tip of the upper blade 72 to a position in which the contact 84 on the center blade is unable to engage the upper contact 76. Each of the various cams 100 on the shaft 102 can be given a profile commensurate with the action required. For example, the lobe can disable the associated switch in only one of the shaft positions or can be designed to disable the switch in various of the possible shaft positions. In the illustrated version, the shaft has six potential positions and the hex portion 104 of the shaft adjacent plate 92 is engaged by a detent spring 106 bearing against the hex shaft and against the spaced anchor pins 108. A manually actuated knob is mounted in the projecting end of shaft 102 or could be connected to the shaft end by a flexible drive cable if necessary.

The jackshaft/cam arrangement could disable the end switch shown disabled by the lever operated mechanism. It would be logical so to do if other (interior) switches were to be selectively disabled also (unless the end switch was in a hot air-dry circuit which the user might want to disable in all cycles). The jackshaft/camshaft arrangement permits six cycle modifications (six positions of the cam shaft) to greatly enhance the program flexibility. If any interior switch is not to be modified, blank spacers can be provided on the jackshaft and camshaft.

We claim:

1. A timer having a rotatable program cam drum journaled in a frame for rotation about an axis and provided with a plurality of cam track operating switches, each switch including a passive blade and an active blade actuated by a cam track to engage the associated passive blade as required by the cam track as the drum is rotated, and manually operable means engageable with said passive blade and mounted in the frame for rotational movement between an enabling position in which said means does not engage said passive blade and a disabling position in which said means engages and moves said passive blade to a position in which it cannot be contacted by said active blade when the active blade is actuated by the cam track.

2. A timer according to claim 1 in which said means includes an actuator which lies under the passive blade in said enabling position and engages and lifts the passive blade into said disabling position.

3. A timer according to claim 2 in which said means is a member having a head on a first side of the frame, said member including a hub having an axis and radial keys projecting therefrom, said hub and keys passing through a cooperating aperture in the frame, said actuator being connected to said hub, said keys engaging a second side of the frame when the member is in either of its positions.

4. A timer according to claim 3 in which said head includes actuating means for rotating the member about the axis of said hub.

5. A timer according to claim 4 in which said actuating means includes a pin projecting from said head offset from said axis, a sliding actuator mounted in the frame and engaged with said pin for actuating the pin, means limiting movement of the sliding actuator between positions in which the member is in the enabling or disabling position.

6. A timer according to claim 4 in which said actuating means comprises a lever arm projecting from the head, means limiting movement of the lever arm between positions corresponding to said enabling and disabling positions.

7. A timer according to claim 6 including spring means biasing the lever arm to one of its positions.

8. A timer according to claim 2 in which said actuator is rotatably mounted on a shaft mounted in the frame on an axis parallel to the drum axis.

9. A timer according to claim 8 including a plurality of actuators mounted on said shaft, each actuator being associated with a separate switch.

10. A timer according to claim 9 in which said means includes, a manually operable shaft mounted in the frame adjacent and parallel to the actuator shaft, and a plurality of cams mounted on and rotatable with said manually operable shaft, each of said cams being associated with an actuator and being profiled to engage and move its associated actuator at a predetermined rotary position of the manually operable shaft whereby predetermined switches can be disabled in the various positions of the manually operable shaft.

11. A timer according to claim 10 in which each actuator includes a cam follower engaged by the associated cam and a switch actuating arm engageable with the passive blade of the associated switch.

* * * * *